US012187501B2

(12) United States Patent
Kim et al.

(10) Patent No.: US 12,187,501 B2
(45) **Date of Patent: *Jan. 7, 2025**

(54) CLOSURE WITH LINER

(71) Applicant: Silgan White Cap LLC, Downers Grove, IL (US)

(72) Inventors: Sungsuk Steve Kim, Batavia, IL (US); Timothy Graham Stephenson, Auckley (GB)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/055,664

(22) Filed: Nov. 15, 2022

(65) Prior Publication Data

US 2023/0075410 A1 Mar. 9, 2023

Related U.S. Application Data

(63) Continuation of application No. 16/937,294, filed on Jul. 23, 2020, now Pat. No. 11,530,077, which is a continuation of application No. 15/483,798, filed on Apr. 10, 2017, now Pat. No. 10,759,575, which is a (Continued)

(51) Int. Cl.

| | |
|---|---|
| ***B65D 47/10*** | (2006.01) |
| ***B65D 41/34*** | (2006.01) |
| ***B65D 51/00*** | (2006.01) |
| ***B65D 53/02*** | (2006.01) |
| ***B65D 53/06*** | (2006.01) |

(52) U.S. Cl.

CPC ..... *B65D 47/106* (2013.01); *B65D 41/3442* (2013.01); *B65D 51/005* (2013.01); *B65D 53/02* (2013.01); *B65D 53/06* (2013.01)

(58) Field of Classification Search

CPC B65D 41/32; B65D 41/3442; B65D 41/3457; B65D 47/10; B65D 47/106; B65D 51/005; B65D 53/02; B65D 53/06

USPC ..... 215/250, 253, 320; 220/315

See application file for complete search history.

(56) References Cited

U.S. PATENT DOCUMENTS

| | | | |
|---|---|---|---|
| 3,722,729 | A | 3/1973 | Yamada |
| 4,106,653 | A | 8/1978 | Martinelli |
| 4,570,811 | A | 2/1986 | Lecinski et al. |

(Continued)

FOREIGN PATENT DOCUMENTS

| | | |
|---|---|---|
| WO | WO2013/119781 | 8/2013 |

OTHER PUBLICATIONS

International Search Report and Written Opinion regarding PCT/US2016/035485, 17 pages, Feb. 28, 2017.

*Primary Examiner* — Nathan J Jenness
*Assistant Examiner* — Madison L Poos
(74) *Attorney, Agent, or Firm* — Reinhart Boerner Van Deuren s.c.

(57) ABSTRACT

A closure for a container is provided with a top portion and a skirt depending from an outer periphery of the top portion. A generally circular rim extends downwards from the lower surface of the top portion. A liner is attached to the closure between an outer surface of the rim and an inner surface of the skirt. The liner is configured to provide a fluid tight seal for containers having varied neck dimensions and/or profiles. One or more projections extend into a space formed between the lower surface of the top portion, an inner surface of the skirt, and an outer surface of the rim, with the liner enveloping and being supported in the closure by the one or more projections.

19 Claims, 16 Drawing Sheets

Related U.S. Application Data continuation of application No. PCT/US2016/035485, filed on Jun. 2, 2016.

(56) References Cited

U.S. PATENT DOCUMENTS

| | | | |
|---|---|---|---|
| 5,687,865 | A | 11/1997 | Adams et al. |
| 5,762,218 | A | 6/1998 | Sachau |
| 8,177,083 | B2 | 5/2012 | Lamoureux et al. |
| 2004/0234713 | A1 | 11/2004 | Celerier et al. |
| 2005/0098529 | A1 | 5/2005 | Bloom et al. |
| 2006/0201905 | A1 | 9/2006 | Perrin et al. |
| 2007/0187352 | A1 | 8/2007 | Kras et al. |
| 2015/0008223 | A1 | 1/2015 | Harada et al. |
| 2015/0321798 | A1 | 11/2015 | Isogai |

CLOSURE WITH LINER

CROSS-REFERENCE TO RELATED PATENT APPLICATIONS

This application is a continuation of U.S. application Ser. No. 16/937,294, filed Jul. 23, 2020, which is a continuation of U.S. application Ser. No. 15/483,798, now U.S. Pat. No. 10,759,575, filed Apr. 10, 2017, which is a continuation of PCT/US16/35485, filed Jun. 2, 2016, priority from each is hereby claimed and each of which are incorporated herein by reference in their entireties.

BACKGROUND OF THE INVENTION

Referring generally to the figures, various embodiments of a closure assembly are described. The closure discussed herein may be particularly suitable for containers, such as large capacity containers (2.5 gallon, 3 gallon, 5 gallon, 6 gallon etc.) configured for use with liquid dispensers. For example, the closure may be used to seal water bottles that are usable in water dispensers.

There is a relatively high degree of standardization in the water bottling industry, as many of the dimensions for closures are required to lie within relatively tight tolerances, in order for the closures to provide an effective liquid-tight seal on a range of conventional container neck finishes. However, variations stemming from bottles being manufactured by different suppliers or in different batches, or wear and tear, etc. may result in some variation between neck lip portion diameters and profiles between bottles.

As such, the closure as discussed herein includes a liner or gasket which is configured to be capable of forming a fluid-tight interface between the closure and the container when the closure is attached to the neck of the container, irrespective of variations between the size and profile of the neck portions of the different types of water bottles to which the closure may be applied. Additionally, the closure includes one or more posts extending from an inner surface of the closure. The one or more posts are configured to provide support and structure to which the liner may adhere to when the liner is flowed into, and allowed to cool in the closure. The additional support of the posts is configured to increase the adherence of the liner to the closure, and prevent and/or resist movement, detachment and/or deformation of the liner during application and removal of the closure to or from a container.

SUMMARY OF THE INVENTION

In one embodiment, a closure for a container includes a top portion and an annular skirt extending downwardly from the top portion. The closure also includes an engagement element for attaching the closure to a container. A circular rim extends downwards from a lower surface of the top portion. The rim terminates at a lower end lying along a generally horizontal plane.

A space is defined between the lower surface of the top portion, an inner surface of the annular skirt, an outer surface of the rim, and the plane on which the lower end of the rim lies. One or more projections extend into or through the space. A liner is located within the space. The liner is attached to, surrounded and supported by the one or more projections.

In one embodiment, a closure for a container includes a top portion and an annular skirt extending downwardly from the top portion. An engagement element extends from the annular skirt to attach the closure to a container. A circular projection extends downwards from a lower surface of the top portion.

A liner extends from the lower surface of the top portion and in-between an inner surface of the annular skirt and an outer surface of the projection. One or more protuberances are attached to at least one of the lower surface of the top portion, the outer surface of the projection and the inner surface of the annular skirt. The one or more protuberances are at least partially enveloped by the liner.

In one embodiment, a method of forming a closure for a container includes providing a top portion and extending an annular skirt downwardly from the top portion. An engagement element for attaching the closure to a container is provided on the closure. A circular rim is extended downwards from a lower surface of the top portion. The rim terminates at a lower end lying along a generally horizontal plane.

A space is defined between the lower surface of the top portion, an inner surface of the annular skirt, an outer surface of the rim, and the plane on which the lower end of the rim lies. One or more projections that extend into or through the space are provided. A liner is poured into the space such that the liner flows around and surrounds the one or more projections. The liner is allowed to cure such that the liner adheres to and is supported by the one or more projections.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1A:
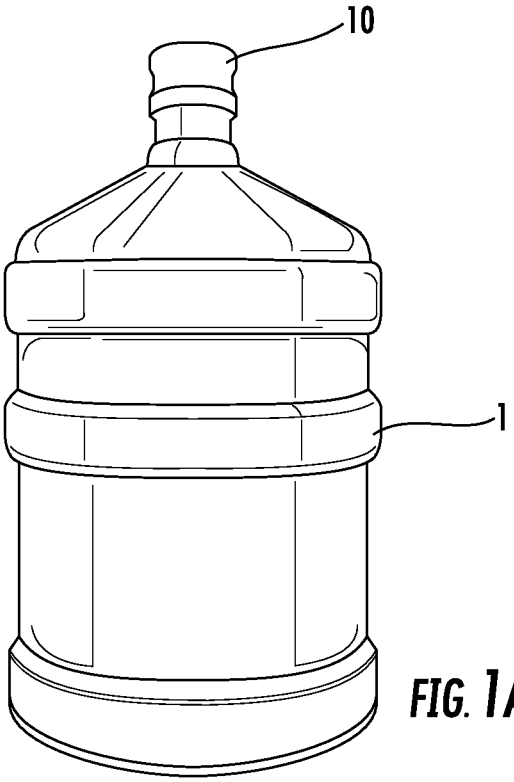
FIG. 1A shows a container assembly including a closure attached to a container according to an exemplary embodiment.
Figure 1B:
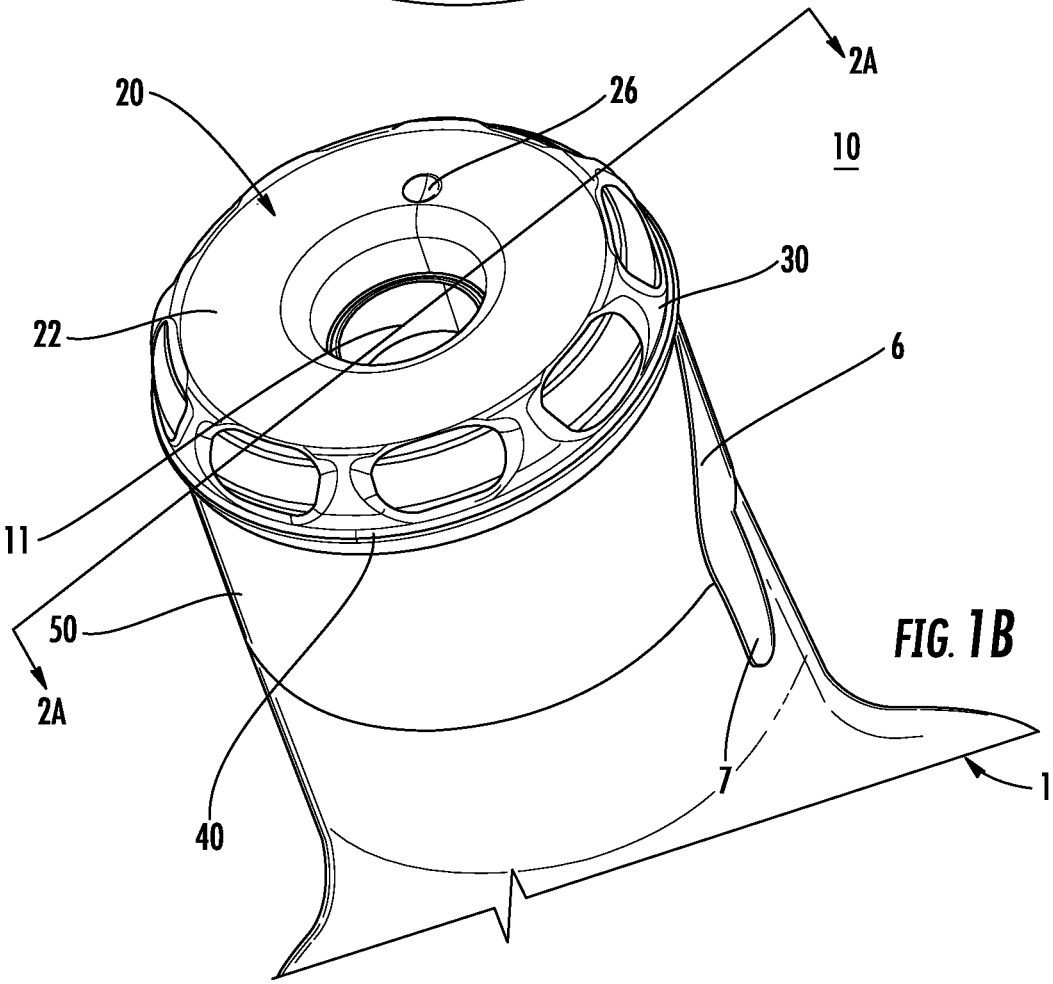
FIG. 1B is a top perspective view of the container assembly of FIG. 1A according to an exemplary embodiment.

Referring to FIG. 1A, a non-spill closure 10 according to one embodiment attached to a water bottle container 1 is shown. As shown in FIG. 1B, the closure 10 has a top 20 in the form of an annular disc 22. Depending downwardly from the outer edge of the top 20 is a shoulder 30, which has a lower edge and a skirt 50 depending downwardly therefrom. The skirt 50 is generally cylindrical and sized so as to fit tightly around the neck 14 of a container 1 to which it is applied. At the intersection between the shoulder 30 and the skirt 50 there is provided an external bead 40. The bead 40 facilitates the manual lifting of the full container 1 of fluid.

A release tab 7 extends longitudinally downwardly from the skirt 50. Tear lines or score lines 6 are applied to the closure 10 during the molding process. Tear lines 6 extend upwardly from the release tab 7 on the surface of the skirt 50. When the release tab 7 is pulled upwards towards the top 20, the tear lines 6 fracture, tearing the skirt 50 and facilitating removal of the closure 10 from the container neck 14.

Figure 2A:
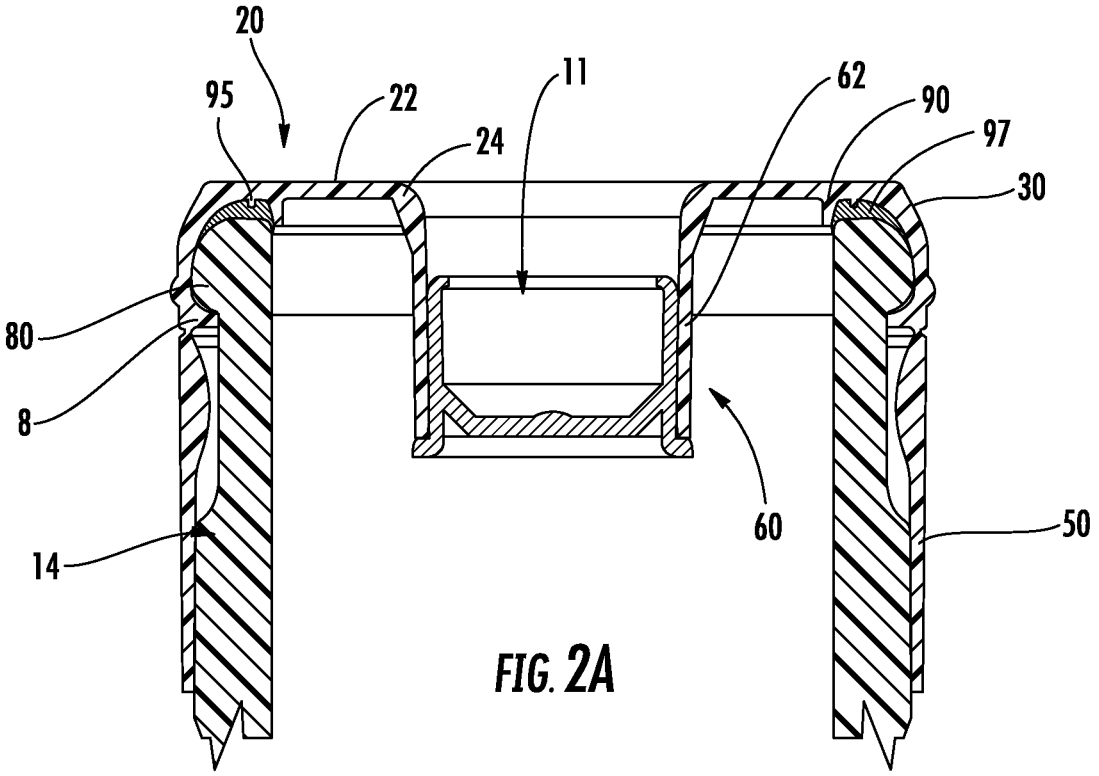
FIG. 2A is a cross-sectional view of the container assembly taken along line 2A-2A of FIG. 1B according to an exemplary embodiment.
Figure 2B:
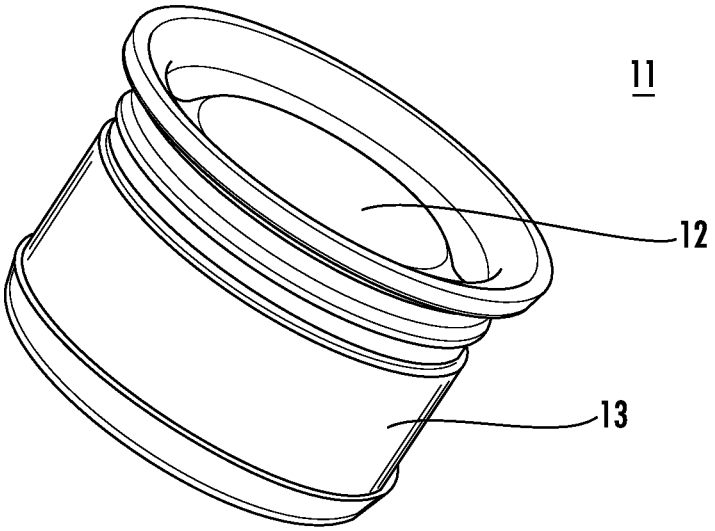
FIG. 2B is a perspective view of a plug according to an exemplary embodiment.

As shown in FIG. 2A, the annular disc 22 of the top 20 has an inner edge 24 that may be sloped or rounded. Inner edge 24 intersects with a well 60 formed by a generally cylindrical side wall 62, which depends downwardly from the inner edge 24 of the annular disc 22 to an open end 75. Fitted snugly within the well 60 is a displaceable plug 11. As illustrated in FIG. 2B, the plug 11 has a bottom 12 and a side wall 13 which when placed in the well 60 of closure 10 closes the open end 75 in order to seal the well 60. As also shown in FIG. 2A, and described in additional detail further below, closure 10 includes an annular rim 90, a post section 95, and a liner 97 depending downwards from the inner surface of closure 10.

Figure 3:
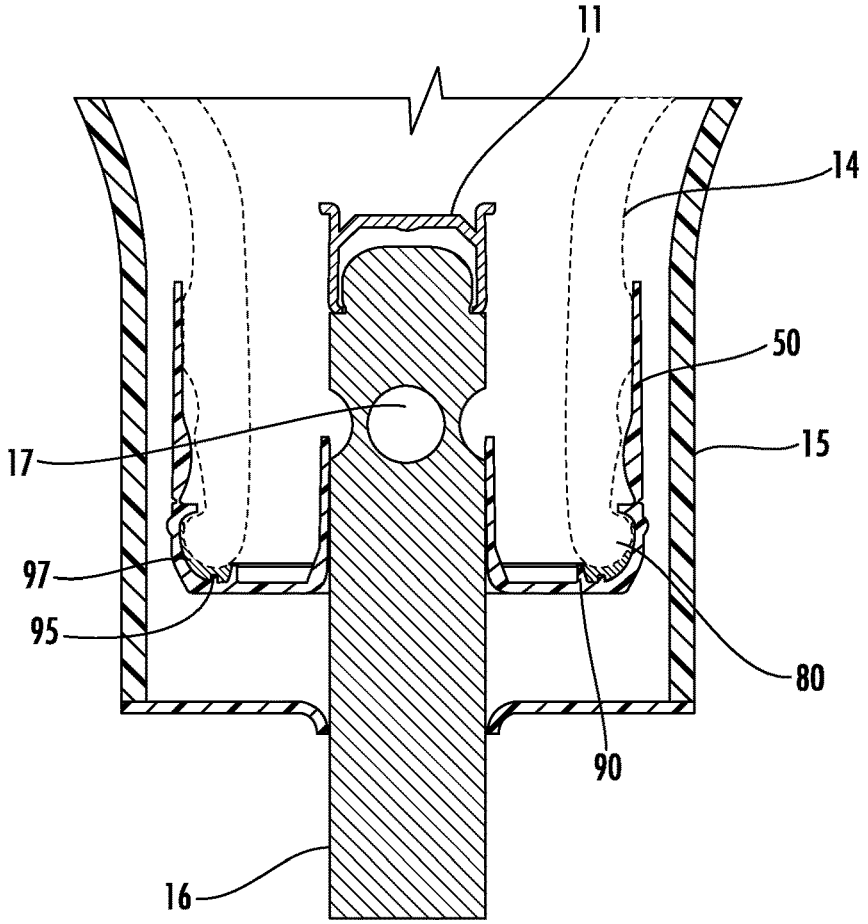
FIG. 3 is a cross-sectional view of the container assembly taken along line 2A-2A of FIG. 1B after being mounted on a dispensing apparatus according to an exemplary embodiment.

FIG. 3 illustrates the situation which results when a container 1 sealed by closure 10 is inverted and lowered into a receptacle 15 of a top-loading dispensing apparatus equipped to cooperatively function with non-spill closure 10. As shown in FIG. 3, the container 1 has been lowered into receptacle 15 whose dimensions help position the container neck 14 axially over a hollow probe 16 of the dispensing apparatus. Annular rim 90, post section 95 and liner 97 of closure are configured to provide a fluid-tight seal between the container 1 and closure 10 prior to and during loading of container 1 into receptacle 15. The probe 16 enters the well 60 of the closure 10 as the container is lowered on to the dispensing apparatus. As the container continues to be lowered into the dispensing apparatus, complimentary features on the plug 11 and probe 16 interact to result in attachment of the plug 11 to the probe 16. In its final position, i.e. once the container has been loaded into the dispensing apparatus, the probe 16 has penetrated into the container neck 14 sufficiently to displace the plug 11 and expose ports 17 of probe 16 to the contents of the container 1. Fluid is then able to enter the inside region of probe 16 through the ports 17 and flow downwardly for dispensing.

Although the closures 10 depicted in FIGS. 1B, 2A, and 3 are shown to include a plug 11 located in well 60 of closure 10, for illustrative purposes plug 11 is not depicted in the well 60 of some of the other embodiments of the closure 10 disclosed herein. However, it is to be understood that closure 10 of any of the embodiments described herein and depicted without a plug 11 could be provided with a plug 11 located in well 60, such as illustrated in exemplary embodiments shown in FIGS. 1B, 2A, and 3. Similarly, for illustrative purposes liner 97 is not depicted in certain figures, but it is to be understood that closure 10 of any of the embodiments described herein and depicted without a liner 97 could be provided with a liner 97.

Figure 4:
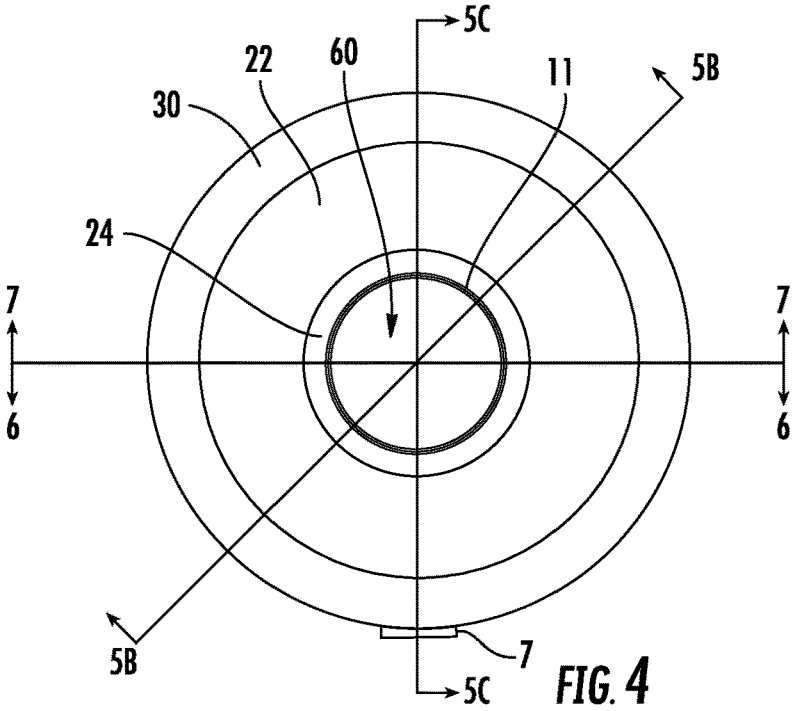
FIG. 4 is a top view of a closure according to an exemplary embodiment.
Figure 5A:
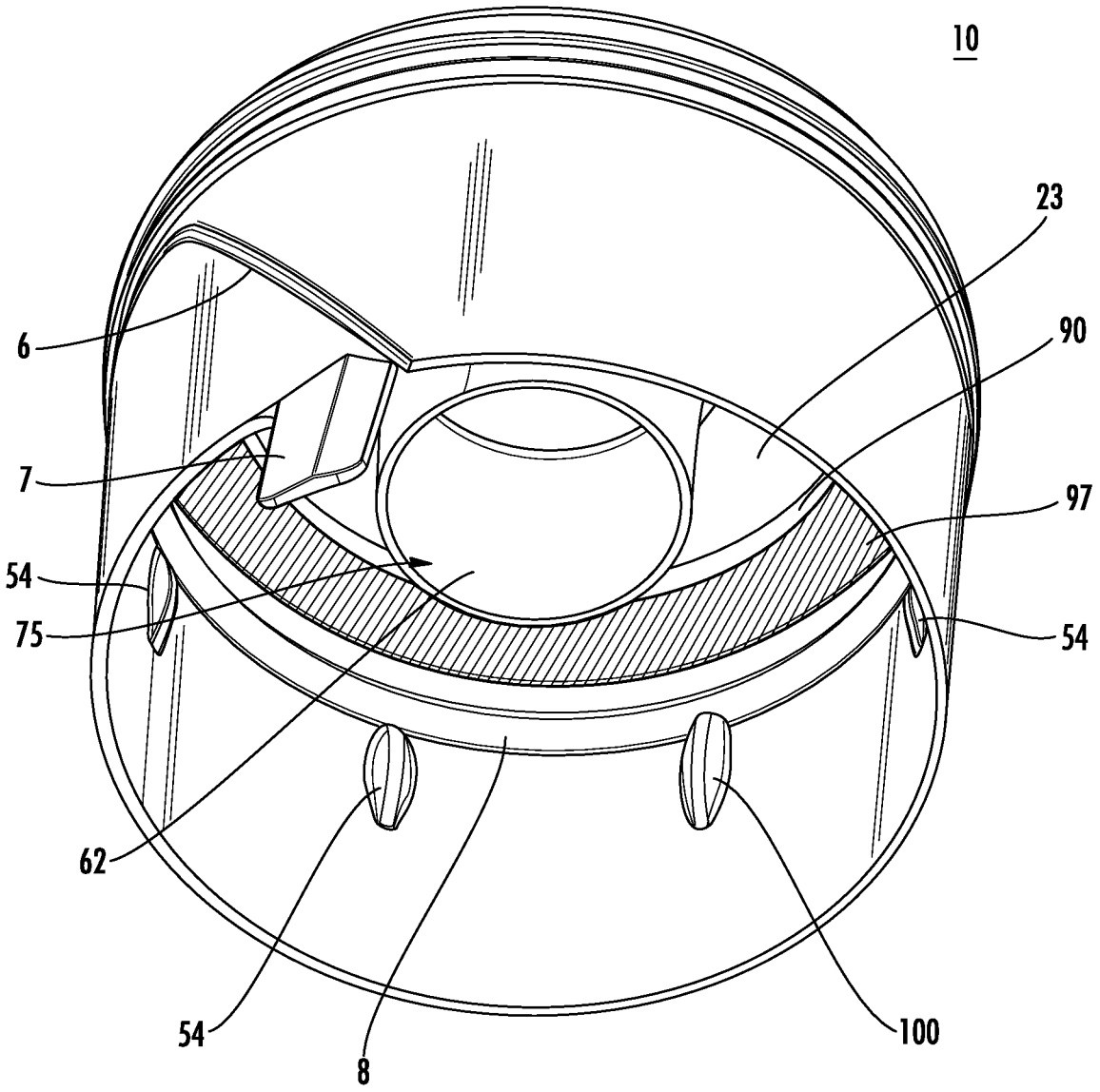
FIG. 5A is a bottom perspective view of a closure of FIG. 4 according to an exemplary embodiment.
Figure 5B:
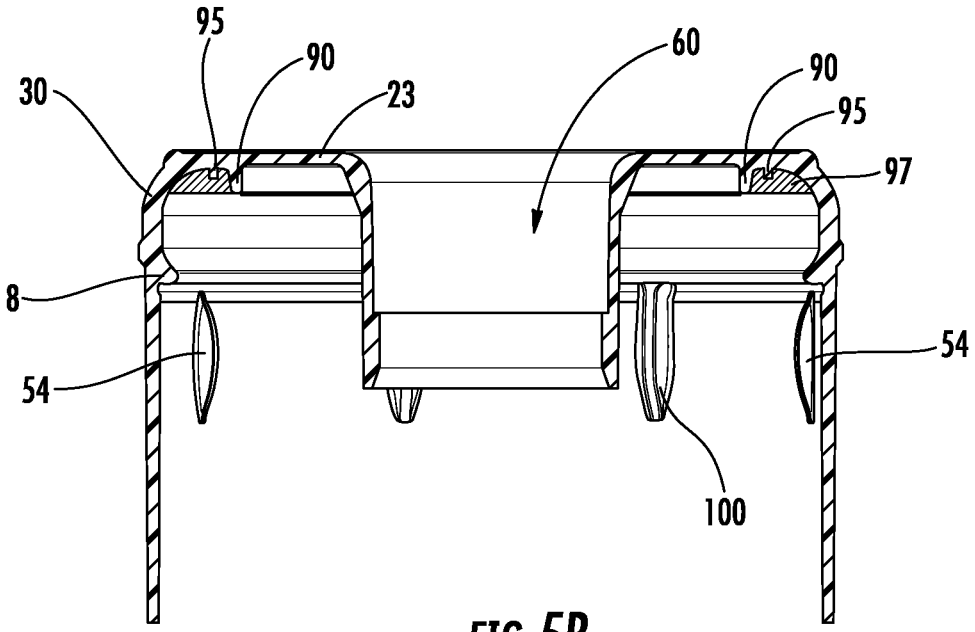
FIG. 5B is a cross-sectional view of the closure of FIG. 4 taken along line 5B-5B of FIG. 4 according to an exemplary embodiment.

FIG. 5A is a bottom perspective view of one embodiment of the closure depicted in FIG. 4, and illustrates the various features found on the interior of closure 10. As shown in FIG. 5B, a tension ring 8, such as, e.g. a snap or locking bead, is located on the inner wall of skirt 50 of closure 10. In some embodiments, tension ring 8 may be replaced by or used in conjunction with another attachment. e.g. threads, for attaching closure 10 to a container 1. The tension ring 8 is positioned and configured to fit under an enlarged diameter lip portion 80 encircling the opening of the neck 14 of the container 1 and to draw the inner surface of annular disc 22 towards the lip portion 80 of the neck 14 so as to provide a fluid tight connection between the container 1 and the closure 10. As shown in FIG. 5A, a liner 97 (described in further detail below) is located along the inner surface of annular disc 22 and is configured to provide a fluid tight connection between the container 1 and the closure 10.

Figure 5C:
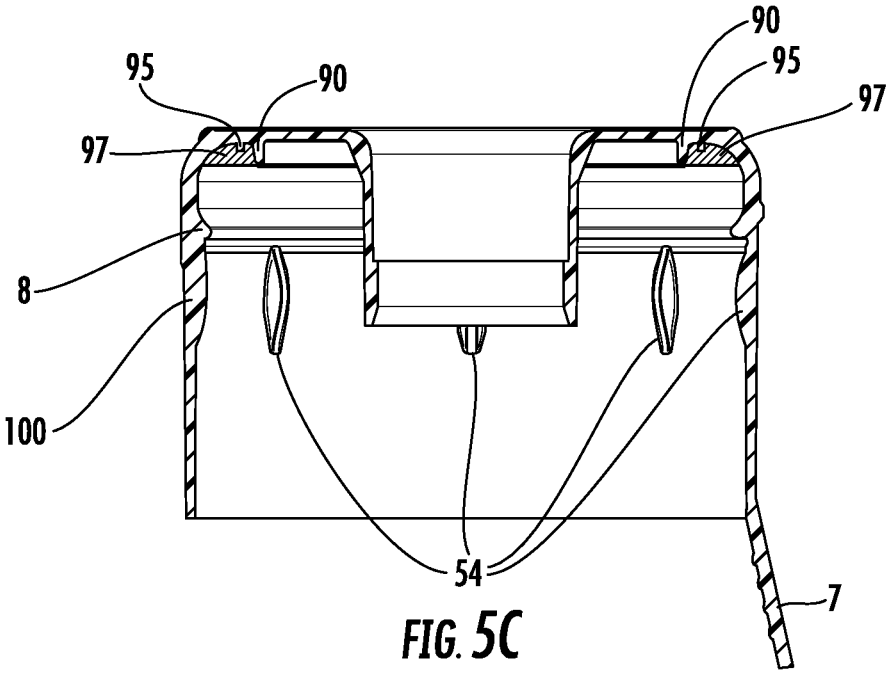
FIG. 5C is cross-sectional view of the closure of FIG. 4 taken along line 5C-5C of FIG. 4 according to an exemplary embodiment.

Also formed on the inner wall of skirt 50, below tension ring 8, are one or more application ramps 54. Such ramps 54 are used to accommodate bottles of varying structural geometries and also function in facilitating capping of the container 1. As the closure 10 is pushed onto the neck 14 of the container 1, lip portion 80 of the container 1 engages the ramps 54. As the lip portion 80 continues to move upwards relative to the ramps 54, skirt 50 is increasingly distorted outwards, until skit 50 has been pushed outwards sufficiently to allow the lip portion 80 to pass under the tension ring 8 and into upper annular space of closure 10. As shown in FIGS. 5A-C, in one embodiment ramps 54 may be formed as rounded projections extending inwardly from the inner wall of skirt 50.

Figure 6:
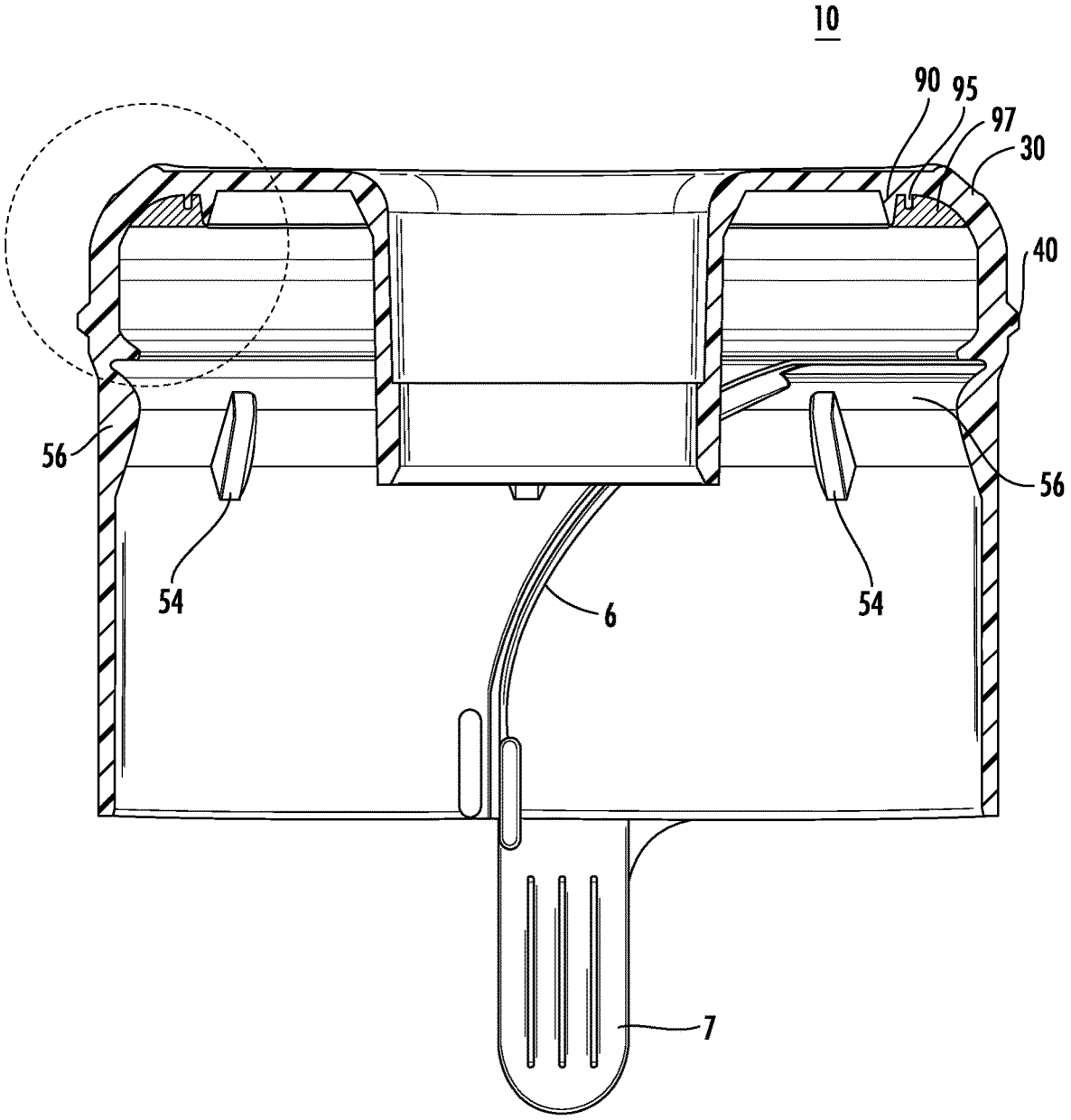
FIG. 6 is a cross-sectional view of a closure of taken along line 6-6 of FIG. 4 according to an exemplary embodiment.

FIG. 6 illustrates another embodiment of the closure 10 of FIG. 4. As shown in the embodiment of closure 10 depicted in FIG. 6, ramps 54 may be formed as angled wedges extending radially inwardly and upwardly from a rounded annular support wall 56 extending about the inner wall of skirt 50. Similar to the embodiment of the closure 10 depicted in FIGS. 5A-5C, the closure 10 of FIG. 6 also includes an annular rim 90, post 95, and liner 97.

Figure 7:
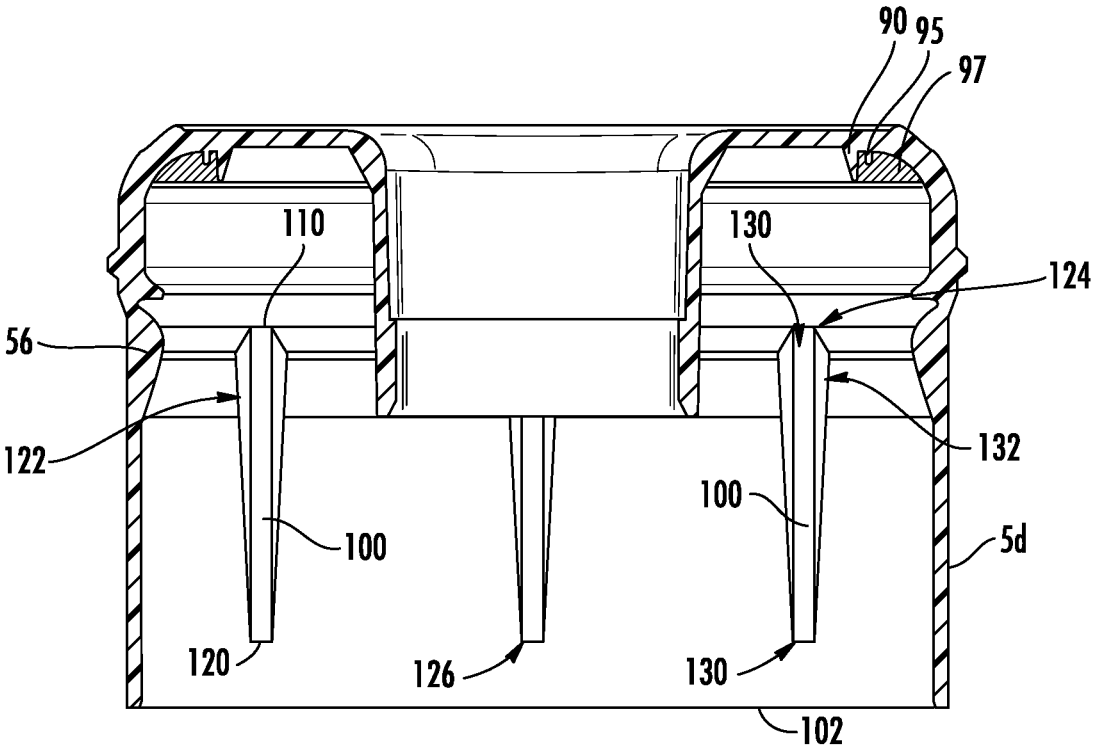
FIG. 7 is a cross-sectional view of a closure taken along line 7-7 of FIG. 4 according to an exemplary embodiment.

Referring to FIG. 7, in some embodiments of the closure 10 of FIG. 4, closure 10 may optionally include one or more extended application ramps 100 located on the portion of skirt 50 opposite release tab 7. Similar to the embodiment of the closure 10 depicted in FIGS. 5A-5C and FIG. 6, the closure 10 of FIG. 7 also includes an annular rim 90, post 95, and liner 97. The benefit of extended application ramps 100 on the portion of the skirt 50 opposite release tab 7 can be understood when one considers conventional practice most often used for applying closures 10 to containers 1. These push-on closures 10 are often applied by first orienting the closure 10 in a chute. When the closure 10 reaches the end of the chute, it assumes a position wherein the closure axis is inclined to the vertical with the lower edge of the closure skirt 50 opposite the release tab 7 disposed vertically lower than the lower edge of the closure skirt 50 adjacent the release tab 7. Closure 10 is held in this position by the release tab 7 being retained in a slot. The container is passed beneath the positioned closure 10 in such a way that the container neck 14 contacts that lower edge of the closure skirt 50 opposite the release tab 7. Further movement of the container "picks" the closure 10 from the chute such that the closure 10 rests gently over the container neck 14, but often in an axially "skewed" position relative the container. The combination closure/container is then subjected to a top load force to push the closure 10 down over the container neck 14 to seal the container 1. However, as a result of the possible axially skewed condition of the closure 10 at pickoff, the final push-on of the closure 10 may not be uniform. Rather, the side of the closure skirt 50 opposite the release tab 7 gets pushed down first, followed by the closure portion containing the release tab 7. Thus the extended application ramps 100 on the closure skirt portion opposite the release tab 7 are configured to assist in air venting at an earlier point in the capping process to promote improved capping performance. It is also believed that the extended application ramps 100 are an advantage because they assist the closure 10 in leveling itself before it sets and is pushed down onto the neck 14.

As shown in FIG. 7 in one embodiment, the one or more extended application ramps 100 may be similar to the ramps 54 shown in the embodiment of FIG. 6, yet are now extended downwardly on closure skirt 50. The lower edge 120 of extended application ramps 100 has an elongated length that causes the lower edge 120 to be positioned above the bottom edge 102 defined by the cylindrical skirt 50. Preferably the lower edge 120 is about 50% to 25% above the bottom edge 102 measured against the entire length of the cylindrical skirt 50.

Each of the ramps 100 of the embodiment shown in FIG. 7 includes a base connected to the inner wall of the cylindrical skirt 50 and includes a profile that extends from the base. The profile is defined as having a maximum thickness 122 at a position between the upper edge 110 and the lower edge 120 and diminishing continuously from the maximum thickness 122 to a first minimum thickness 124 substantially about the upper edge 110 and to a second minimum thickness 126 substantially at the lower edge 120. The profile further slants from the maximum thickness 122 to the first 124 and second 126 minimum thicknesses. It is further contemplated by the present invention that the first and second minimum thicknesses are substantially the same. Furthermore, the maximum thickness 122 may be closer towards the upper edge 110.

In another embodiment the base of ramps 100 may be further defined as having a first width 130 defined about the upper edge 110 and the lower edge 110 and a second width 132 defined at a position between the upper and lower edges. While it is contemplated in having the first and second widths substantially the same, the second width 132 may be greater than the first width 130.

Shown in FIGS. 5A-C is another embodiment of extended application ramp(s) 100 that may be incorporated into closure 10. As illustrated in FIGS. 5A-C, application ramp(s) 100 may take the form of one or more rounded projection(s) that is slightly larger in dimension than ramps 54 of FIGS. 5A-5C and which extends further upwards toward the lower end of tension ring 8 than application ramps 54.

Although the extended application ramps 100 have been described as being located on the portion of the skirt 50 opposite the release tab 7, it is to be understood that the extended application ramps 100 may be positioned along any portion of the inner surface of skirt 50. Additionally, in some embodiments, some or all of application ramps 54 may be replaced with extended application ramps 100.

Figure 8A:
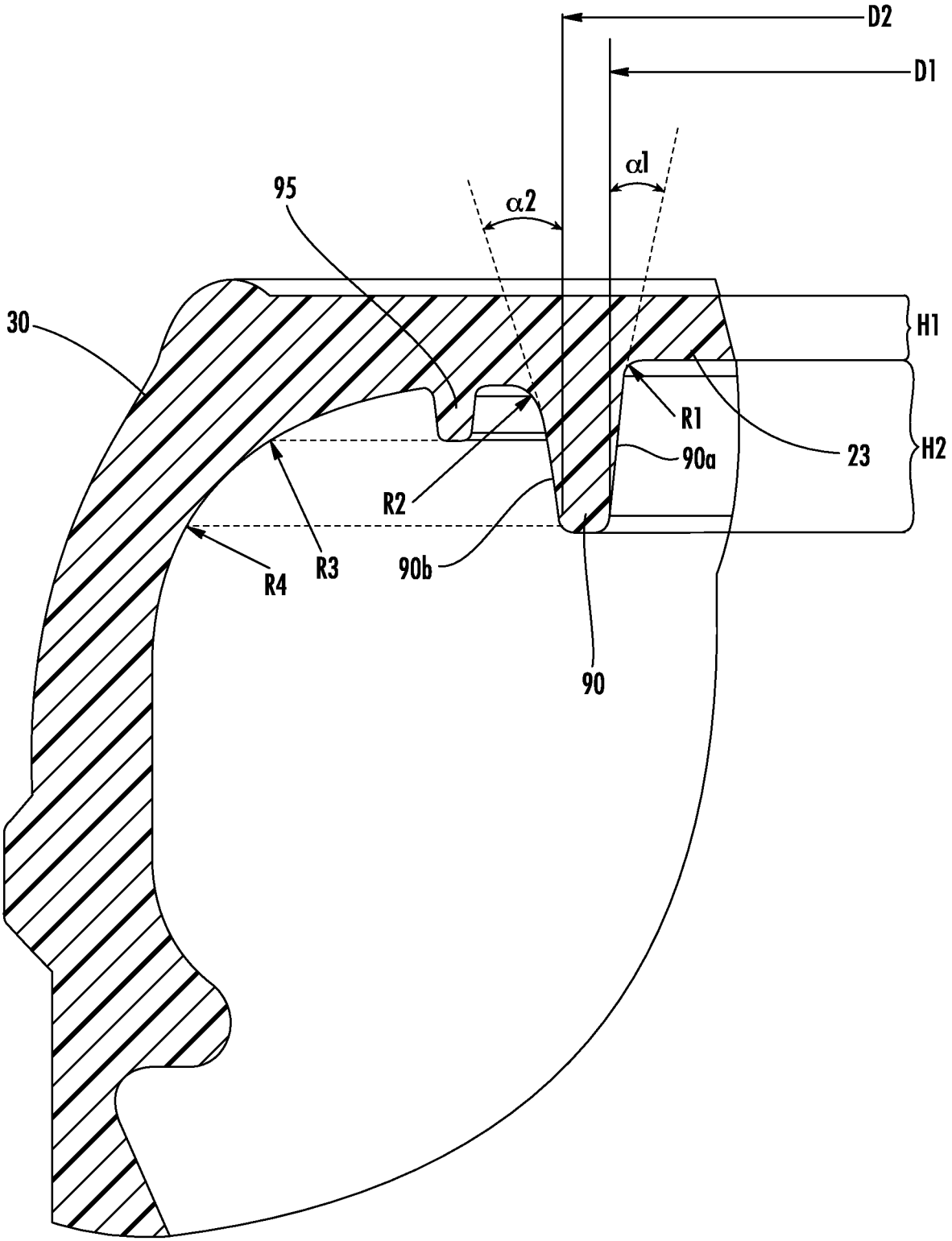
FIGS. 8A and 8B are detailed cross-sectional views of the circled portion of the closure shown in FIG. 6 according to an exemplary embodiment.
Figure 8B:
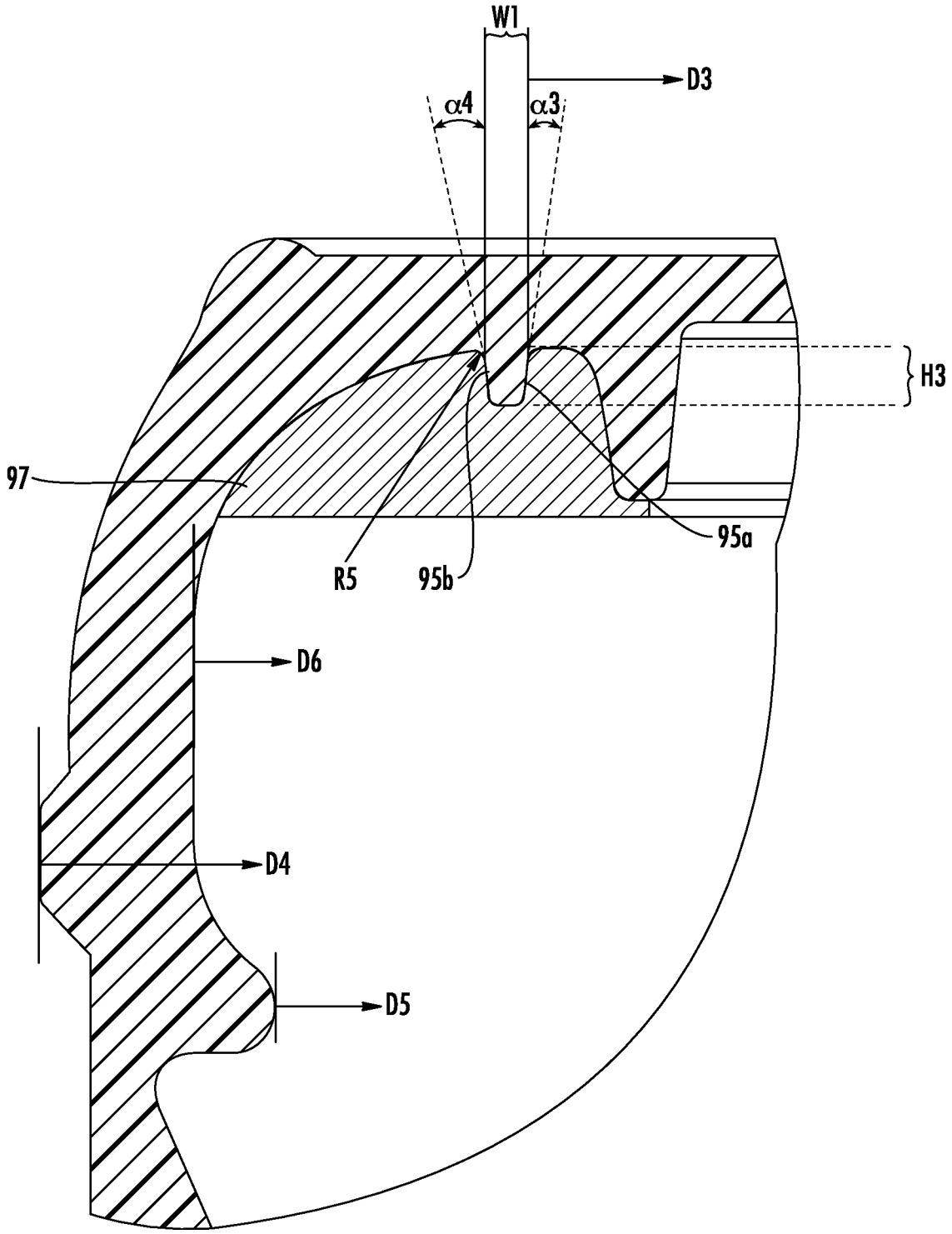
Figure 9A:
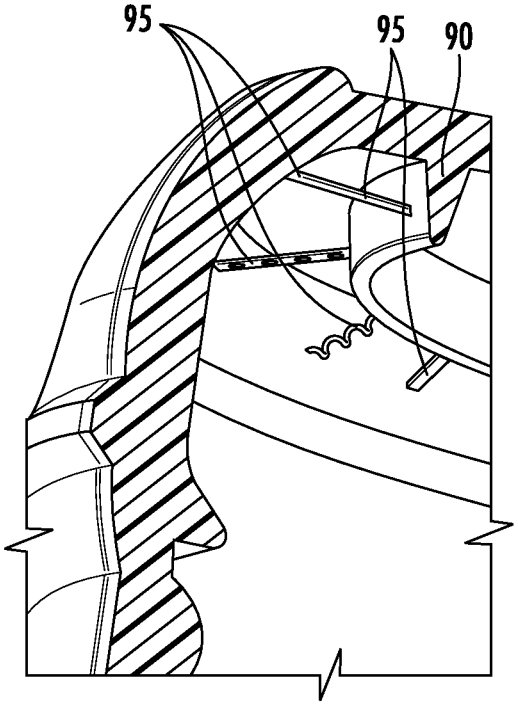
FIGS. 9A-E are detailed perspective cross-sectional views of closures that depict various exemplary embodiments of post sections, the views of FIGS. 9A-E being taken at similar portions of the closures as the circled portion of the closure of the embodiment of FIG. 6.
Figure 9B:
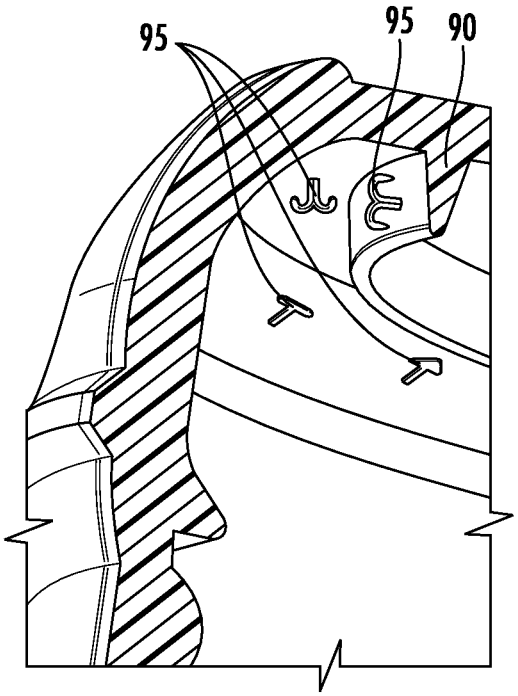
Figure 9C:
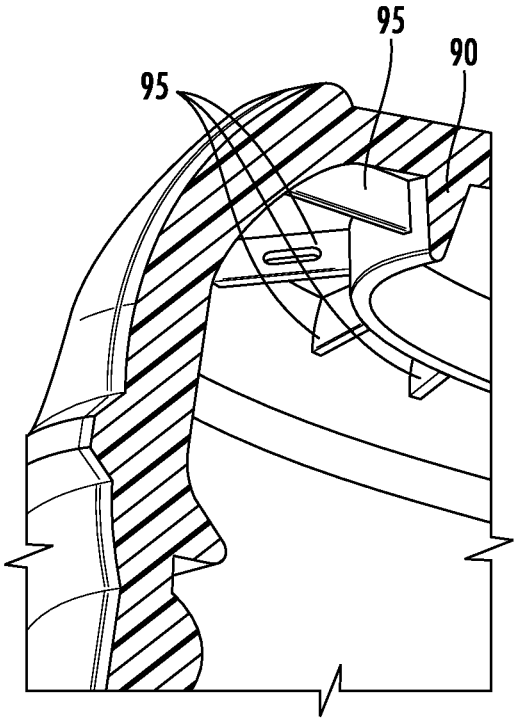
Figure 9D:
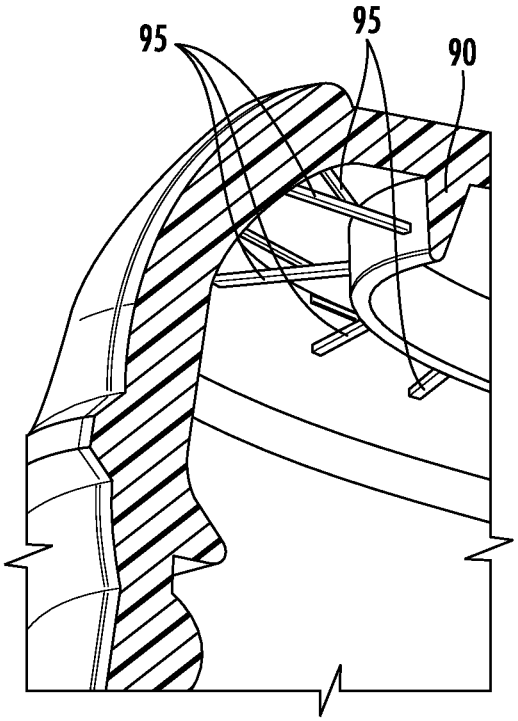
Figure 9E:
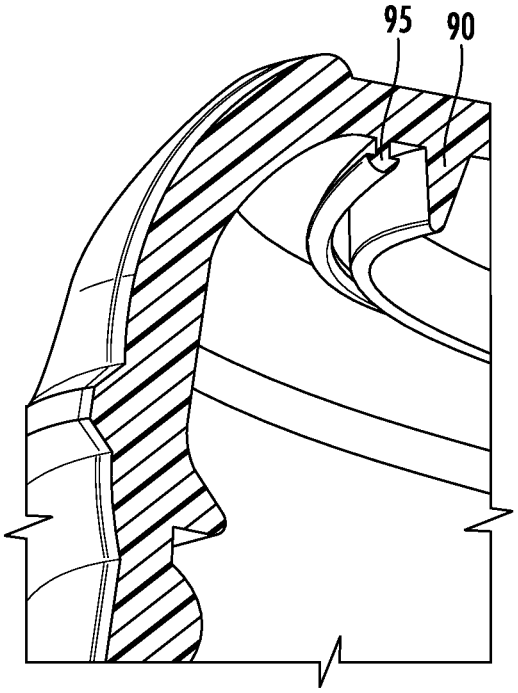
Figure 10A:
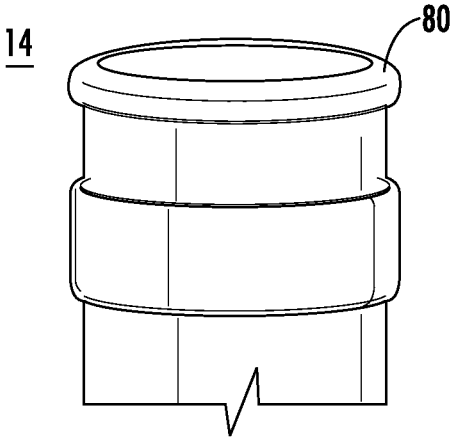
FIGS. 10A-D are perspective views of container necks according to various exemplary embodiments.
Figure 10B:
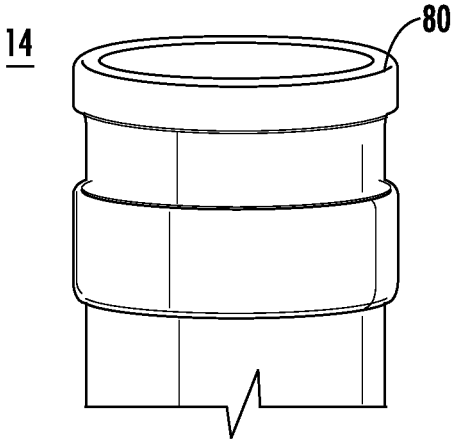
Figure 10C:
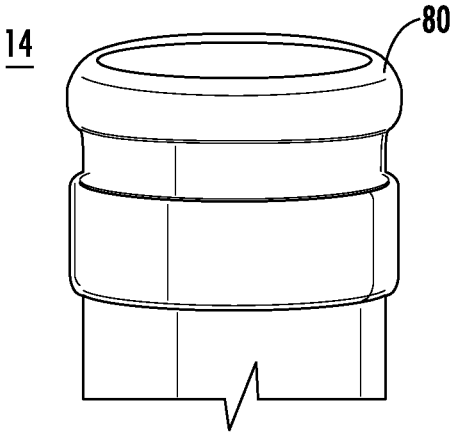
Figure 10D:
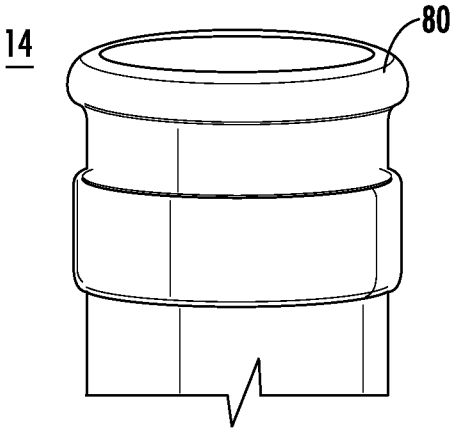

FIGS. 8A and 8B are detailed views of the portion of the closure 10 shown by the dashed circle in FIG. 6. For purposes of illustration, the liner 97 is not shown in FIG. 8A. As shown in FIG. 8A, closure 10 includes an uninterrupted annular rim 90 extending circumferentially downward from top 20. Annular rim 90 extends at a distance from the center of closure 10 that is generally similar to the radius of a typical container 1 neck opening. Annular rim 90 is configured to engage neck 14 of container 1 to form a seal to prevent the contents of container 1 from leaking once the container 1 has been sealed by closure 10.

In one embodiment, as depicted in FIG. 8A, inner wall 90*a* of rim 90 is angled outwards relative to the longitudinal axis of the closure 10 at an angle $\alpha$1 of between 1° and 10°. In some embodiments, angle $\alpha$1 is about 5°±1°. The bottommost portion of inner wall 90*a* is located at a distance D1 of between 0.6 and 1.0 inches from the center of closure 10. In one embodiment, the distance is approximately 0.8125±0.005 inches from the center of closure 10. Located directly radially inwards of inner wall 90*a* is an inner portion 23 of annular disc 22. Inner portion 23 of annular disc 22 has a thickness H1 of between 0.01 and 0.08 inches, and in some embodiments, a thickness of approximately 0.035±0.005 inches.

Outer wall 90*b* of rim 90 is angled inward relative to the longitudinal axis of the closure 10 at an angle $\alpha$2 of between 5° and 15°. In some embodiments, angle $\alpha$2 is about 100° 1°. The bottommost portion of outer wall 90*b* is located at a distance D2 of approximately 0.5 and 1.0 inches from the center of the closure 10. In some embodiments, outer wall 90*b* is located approximately 0.8375±0.005 inches from the center of closure 10. The height H2 of rim 90, as measured from the point at which outer wall 90*b* attaches to the top 20 to the bottommost portion of outer wall 90*b*, is between 0.04 and 0.15 inches, and in some embodiments approximately 0.080±0.005 inches.

The radius of curvature R1 at the connection between the inner wall 90*a* and the annular disc 22 is approximately 0.010±0.005 inches. The radius of curvature R2 at the connection between the outer wall 90*b* and the annular disc 22 is approximately 0.020±0.005 inches. As also seen in FIG. 8A, at a location where a plane on which the bottom surface of post 95 terminates intersects with shoulder 30, the radius of curvature R3 of the inner surface of the shoulder 30 is approximately 0.190±0.005 inches. At a location where a plane on which the bottom surface of sealing rim 90 terminates intersects with shoulder 30, the radius of curvature R4 of the inner surface of shoulder 30 is approximately 0.140±0.005 inches.

As seen in FIG. 8B, closure 10 includes a gasket or liner 97 located along the inside portion of closure 10. Liner 97 is formed of a compressible polymeric material which is flowed in to closure 10 after closure 10 has been molded and is allowed to cure is situ. The liner 97 is formed with closure 10 such that the liner 97 extends downwards from the lower surface of top 20. In some embodiments, liner 97 extends further downwards from top 20 than rim 90. Liner 97 is bounded at its inner periphery by outer wall 90*b* of rim and liner 97 extends outwards towards the inner surface of shoulder 30 and/or the inner surface of skirt 50.

When liner 97 is flowed into closure 10 and allowed to cure, liner 97 adheres to the lower surface of top 20, the outer surface of annular rim 90, and the inner surface of shoulder 30 and/or the inner surface of skirt 50. However, in many situations the attachment of liner 97 to only these surfaces (i.e. the lower surface of top 20, the outer surface of annular rim 90, and the inner surface of shoulder 30 and/or the inner surface of skirt 50) is not sufficient to provide a supported, stable connection of the liner 97 to closure 10.

Specifically, in some embodiments the affinity of the liner 97 to the surface of the closure 10 may be less than the affinity of the liner 97 to the surface of neck 14 of container 1. As a result, when closure 10 moves relative to container 1 during application of the closure 10 to container 1, the greater friction and/or higher adherence between liner 97 and lip portion 80 of container 1 than between liner 97 and closure 10 in conjunction with the resultant forces on the liner 97 imparted during application of the closure 10 may result in liner 97 detaching and/or dislodging from closure 10. As a result of such displacement and/or detachment of liner 97 during application of closure 10 to container 1, the liner 97 may no longer be capable of providing a fluid tight seal of container 1.

The greater friction and/or higher adherence between liner 97 and lip portion 80 of container 1 than between liner 97 and closure 10 may also create issues during removal of closure 10 from container 1. Specifically, when closure 10 is removed from container 1, the greater affinity between liner 97 and container 1 than between liner 97 and closure 10 may cause all or part of liner 97 to detach from closure 10 during removal. In some situations, in addition to detaching from closure 10, liner 97 may also detach from lip portion 80 during removal of the closure. However, in some situations, the portion of liner 97 that has detached from closure 10 may remain attached and/or adhered to the lip portion 80 of container 1. An increased likelihood of all of or some of liner 97 remaining adhered to lip portion 80 may result from situations in which, for example, sealed containers 1 have been stored for long periods of time, when containers 1 have been stacked and/or stored in such a manner that the lip portion 80 of container 1 was subject to pressure during storage, and/or the container 1 was stored in a warm or high temperature environment.

Because containers 1 are typically refilled and resealed after use, the adherence of liner 97 to lip portion 80 of container 1 may be problematic to the process of reusing containers 1. In such situations, the container 1 refilling and resealing process would require the additional steps of inspecting and removing liner 97 from lip portion 80. Otherwise, where such extra steps to rid the lip portion 80 of attached liner 97 were not taken, the subsequent attachment of closure 10 to container 1 and/or the fluid-tight seal provided between closure 10 and container 1 could be impaired.

As a result of issues that may arise from the weak bond, connection, adhesion or adherence between the inner surfaces of closure 10 and liner 97, the closure 10 may include one or more post sections 95 configured to provide additional support and surface area for liner 97 to attach and adhere to. As liner 97 is flowed into closure 10 and allowed to cure about the lower surface of top 20, the outer surface of annular rim 90, and the inner surface of shoulder 30 and/or the inner surface of skirt 50, liner 97 also cures about and attaches to post(s) 95. The additional surface area, surface texture, structure, spacing and/or geometry of post 95 is configured to prevent liner 97 from deforming and/or detaching from closure 10 during or after application of closure 10 and during removal of closure 10 from container 1.

As shown in FIG. 8B, in one embodiment closure 10 includes an annular post 95 located radially outwardly from sealing rim 90 and extending circumferentially downward from a thickened portion 21 of top 20. Post 95 has an inner wall 95*a* that is angled outwards relative to the longitudinal axis of the closure 10 at an angle $\alpha$3 between 1° and 10°, and in one embodiment between about 5°±1°. Outer wall 95*b* of post 95 is angled outwards relative to the longitudinal axis of the closure 10 at an angle $\alpha$4 between 1° and 10°, and in one embodiment between about 5°±1°. Post 95 extends downwards from thickened portion 21 of top 20 for a distance H3 of about 0.01 and 0.06 inches. In one embodiment, post 95 extends from top 20 for a distance of approximately 0.030±0.005 inches. The bottommost portion of inner wall 95*a* is located at a distance D3 of 0.5 and 1.0 inches from the center of closure 10, and in some embodiments, approximately 0.885±0.005 inches from the center of closure 10. The width Wi between the bottommost portion of inner wall 95*a* and the bottommost portion of outer wall 95*b* is between 0.005 and 0.5 inches, or in some embodiments approximately 0.020±0.005 inches. In some embodiments, post 95 extends from top 20 such that post 95 circumferentially surrounds rim 90 with an unbroken and uninterrupted periphery. In other embodiments, post 95 can be formed of two or more sections, such that post 95 circumferentially surrounds rim 90 with a broken and interrupted periphery.

At its widest point, the inner surface of shoulder has a diameter D4 of between 1.7 and 2.5 inches. In some embodiments the inner surface of shoulder has a diameter of approximately 2.126±0.005 inches. Tensions ring 8 has a diameter D5 of between 1.5 and 2.4 inches, and in some embodiments approximately 2.040±0.005 inches. The external diameter D6 of shoulder 30 is between 2.0 and 2.5 inches, or in some embodiments approximately 2.257 f 0.005 inches. The radius of curvature R5 between the outer wall 95*b* of post 95 and upper surface of top 20 is approximately 0.005±0.005.

Although in the embodiment of closure 10 as shown in FIGS. 8A and 8B post 95 is described as a circular projection extending annularly downward in a broken or unbroken circumferential manner from top 20, post 95 may take any number of forms, and may be attached to any one or more of the lower surface of top 20, the outer surface 90*b* of rim 90, the inner surface of skirt 50 and/or the inner surface of shoulder 30.

Shown in FIGS. 9A-E are various illustrative embodiments of the various embodiments of post(s) 95 and/or the various embodiments of spacing and/or positioning of post(s) 95 about the inner surface of closure 10. The views of closure 10 shown in the various embodiments of FIGS. 9A-E are taken at a similar portion of closure 10 as depicted by the dashed circle in the embodiment of the closure 10 shown in FIG. 6. For illustrative purposes, the closures 10 shown in FIGS. 9A-E are shown prior to the incorporation of liner 97 into closure 10.

As shown in FIGS. 9A-E, post(s) 95 may take forms such as, but not limited to projections, protuberances, protrusions, flanges, spikes, fingers, hooks, struts, barbs, knobs, webs, etc. which extend into the space into which the liner 97 is poured into to cure. Shown in FIGS. 9A-E are varied posts 95 attached to varied surfaces about the inner surface of closure 10. As shown, for example, in FIGS. 9A-C, in some embodiments of closure 10, each post 95 may be shaped and/or sized differently, and/or may be located on different portions of the inner surface of the closure 10. In other embodiments of closure 10, posts 95 of closure 10 may include a single variation of a post 95 shape, with each post 95 being attached to the same portion of the inner surface of closure 10.

As liner 97 cures, liner 97 envelopes and adheres to posts 95, with the post 95 forming a support for liner 97 to prevent detachment of the liner 97 from closure 10. In some embodiments, the outer surface of post 95 may be formed to maximize the surface area of the post 95 and thereby provide more area to which liner 97 may attach to and be supported by. Similarly, the outer surface of post 95 may be textured or patterned to increase the adherence of liner 97 to post 95. For example, the outer surface of post 95 may be patterned, spiraled, dimpled, include one or more passages extending therethrough, etc.

Post 95 may extend annularly from an inner surface of closure 10 as a single unitary, unbroken projection. In other embodiments, post 95 may be formed of more than one post sections. Post 95, either as a unitary structure or as multiple segments, may extend circumferentially about the entire closure 10. In some embodiments, post 95 may extend along only a portion of the circumference of closure 10. In some embodiments, post(s) 95 may be formed monolithically with the closure 10 to form a single unitary structure. In other embodiments, post(s) 95 may be attached to closure 10 subsequent to the formation of closure 10.

Although as shown in the embodiment of FIGS. 8A and 8B post 95 extends generally perpendicularly from the inner surface of top 20, in other embodiments, post 95 may extend from inner surface of closure 10 at any angle. In some embodiments, post 95 may include a plurality of individual posts 95 that extend from various positions and at various angles from any one or more of the lower surface of top 20, the outer surface 90*b* of rim 90, the inner surface of skirt 50 and/or the inner surface of shoulder 30.

In various embodiments, post 95 is connected to an inner surface of closure 10 at only one end. In other embodiments, post 95 may be attached to a first inner surface of closure 10 at one end, and to the same or another inner surface at a second end of post 95. For example, in one embodiment one or more posts 95 may extend in a strut or spoke-like manner between the inner surface of shoulder 30 and the outer surface 90*b* of rim 90.

Water dispensers are generally constructed such that containers supplied by different manufactures may be used interchangeably when replacing empty water containers. Accordingly, large water containers for use in dispensers are typically manufactured with generally similar neck profiles and dimensions. Typically, neck portions 14 of containers 1 have a lip portion 80 outer diameter of between 1.9 and 2.5 inches, or in some embodiments approximately 2.17 t 0.05 inches. The inner diameter of lip portion 80 is generally between 1.6 and 1.9 inches, or in some embodiments approximately 1.73±0.05 inches. However, as shown by the exemplary embodiments illustrated in FIGS. 10A-10D, design variations resulting from: bottles being produced by different manufacturers, differing manufacturing techniques, bottles being manufactured as part of different batches; distortion and/or wear and tear resulting from use, etc. may result in slight variations between the neck profiles and dimensions among containers. As shown in FIG. 10A-10D, among these differences may be variations in: internal neck opening diameter, external neck diameter, external diameter of lip portion 80, width and/or height of lip portion 80, curvature of lip portion 80, external diameter of reduced diameter neck portion 79, etc.

These slight variations in neck profiles and/or dimensions, such as those exemplary embodiments shown in FIGS. 10A-10D, may not impact the interchangeability of the containers for use in various water dispensers. However, for a supplier tasked with exchanging, refilling and resealing water containers having slightly differing neck profiles and/or dimensions, these slight variations may affect the supplier's ability to easily, quickly, consistently and effectively refill and reseal the containers in a fluid-tight manner. For example, a supplier could provide a fluid-tight seal for each container by separating containers based on neck profile and sealing containers with different neck profiles with closures specific to that neck profile. However, such an option would be impractical because of the amount of work required to sort containers and additional expenses and hassle of ordering various sized and/or shaped closures specific to each different neck profile. Instead, most suppliers resort to sealing containers, regardless of neck profile, with a single, generally universal, closure design having an internal structure that generally matches that of the various neck profiles. Although such generally universal closures allow for a supplier to easily and quickly seal containers, because the closure structure is not configured to correspond to specific neck profiles, a fluid tight seal will not be consistently achieved when sealing the containers with such a single, general closure.

Figure 11A:
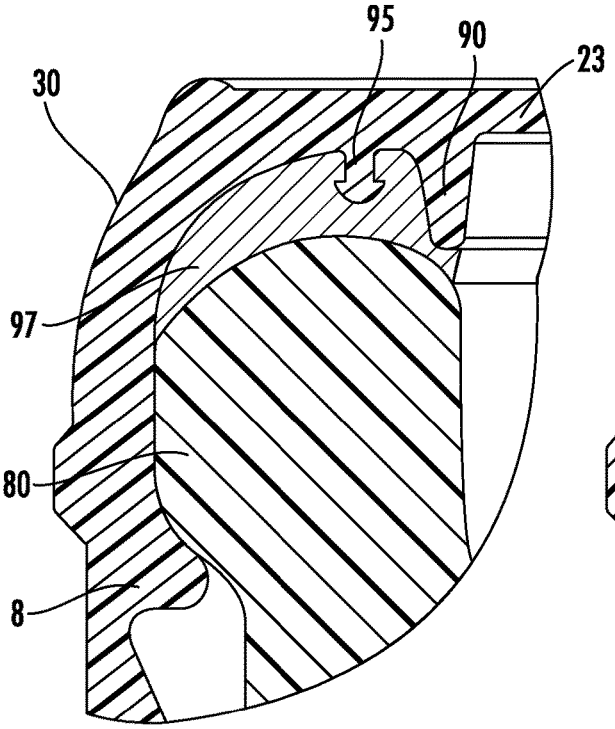
FIGS. 11A-D are detailed cross-sectional views of the container necks of FIGS. 10A-D attached to various embodiments of closures having varied posts, the views of FIGS. 11A-D taken at similar portions of the closures as shown by the circled portion of the closure embodiment depicted in FIG. 6.
Figure 11B:
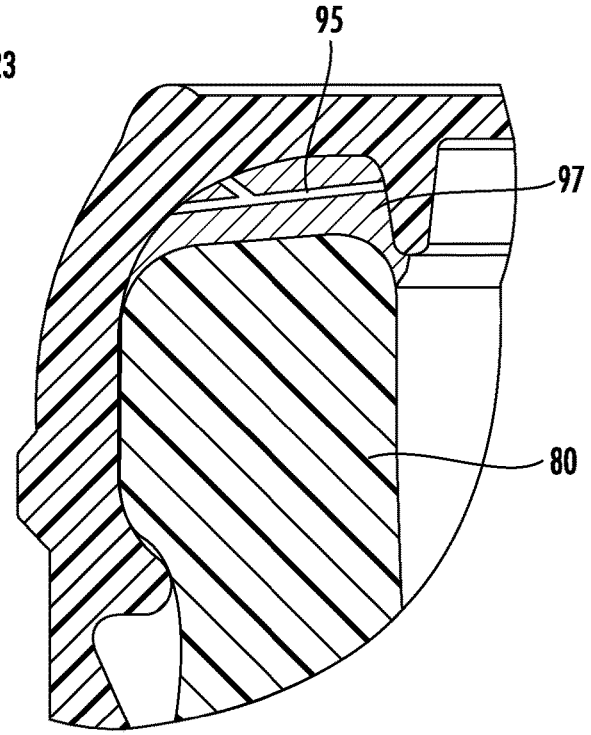
Figure 11C:
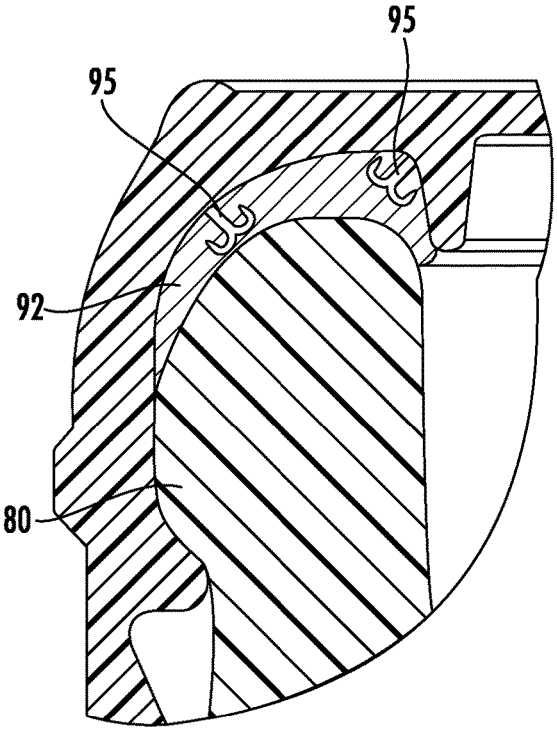
Figure 11D:
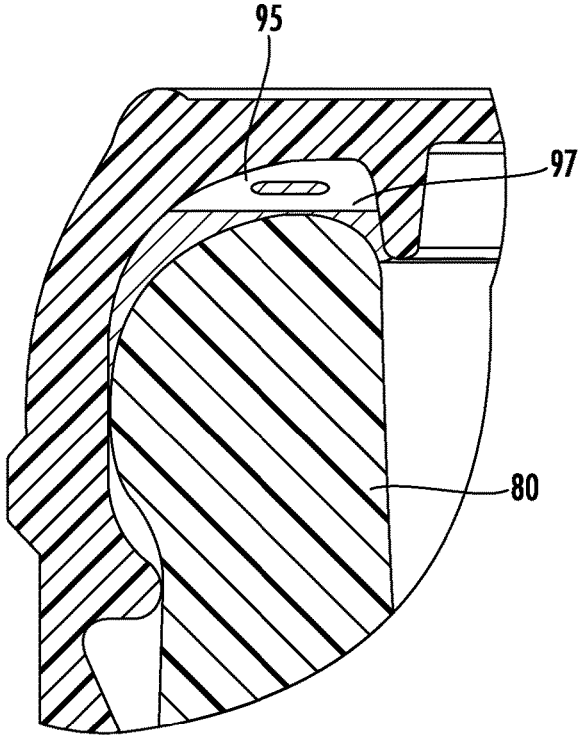

Shown in FIGS. 11A-11D are detailed cross-sectional views of containers having neck profiles as depicted in FIGS. 10A-10D attached to various embodiments of closures 10 having varying posts 95. The portions of closure 10 depicted in FIGS. 11A-11D are generally the same portion of closure 10 as depicted by the dashed circle shown in the embodiment of closure 10 illustrated in FIG. 6. FIG. 11A generally depicts a cross-sectional view of a closure having a post 95 similar to post 95 of the embodiment of closure 10 of FIG. 9E. FIG. 11B generally depicts a cross-sectional view taken of a closure having a post 95 similar to post 95 of the embodiment of closure 10 of FIG. 9D. FIG. 11D generally depicts a cross-sectional view of a closure having a post 95 similar to post 95 of the embodiment of closure 10 of FIG. 9C. As shown in FIG. 11C, in one embodiment, posts 95 have a generally a hook or barb-like shape, and are attached to the inner surface of shoulder 30 and inner surface of rim 90.

As also shown in FIGS. 11A-11D, the liner 97 incorporated into closure 10 provides a solution configured to provide a fluid-tight seal for containers having varied neck profiles. As illustrated by FIGS. 11A-11D, when closure 10 is attached to container 1, the lip portion 80 of neck engages line 80. As the lip portion 80 engages liner 97, the lip portion 80 exerts a force on liner 97, which compresses the liner 97 upwards and outwards. Depending on the profile and/or dimensions of the lip portion 80, the extent to which the liner 97 is compressed varies. When closure 10 is used with containers 1 whose lip portions 80 do not extend all the way outwards to rim 90 or other whose lip portion 80 is otherwise not fluidly sealed by rim 90, the displaced liner 97 is configured to provide a fluid-tight seal between the lip portion 80 and the closure 10.

Figure 12A:
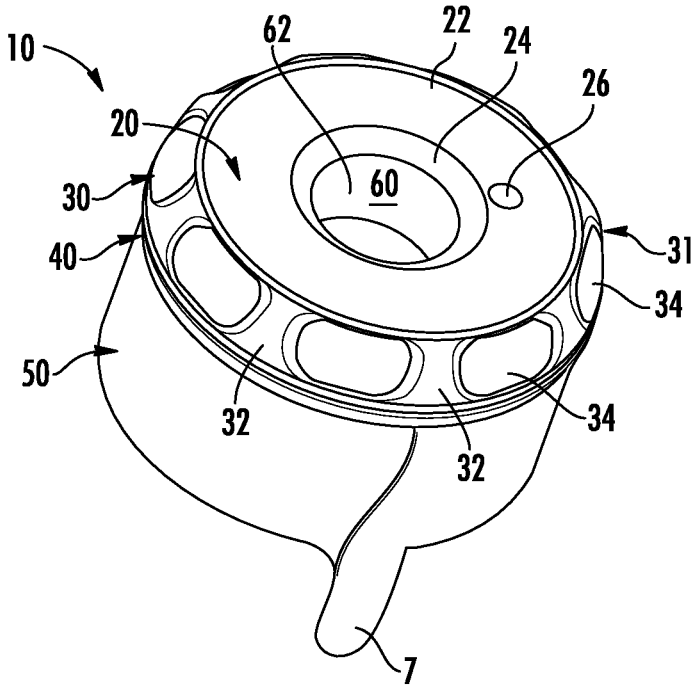
FIGS. 12A and 12B are perspective views of a closure according to an exemplary embodiment.

Referring to FIGS. 12A and B. 13A and 13B, 14 and 15, optional features useable with the closure described above are discussed.

As shown in FIG. 12A, on the surface of the annular disc 22 is an injection point 26. This is a minor irregularity in the otherwise generally planar surface of the annular disc 22 and results from the molding process used to fabricate the closure 10. A remnant 26 corresponds to the part of the closure 10 which was coincident with the injection point, or injection gate (not shown), from which molten resin was introduced into the mold. The size of the remnant 26 is typically of the order of 1 to 5 mm.

Figure 12B:
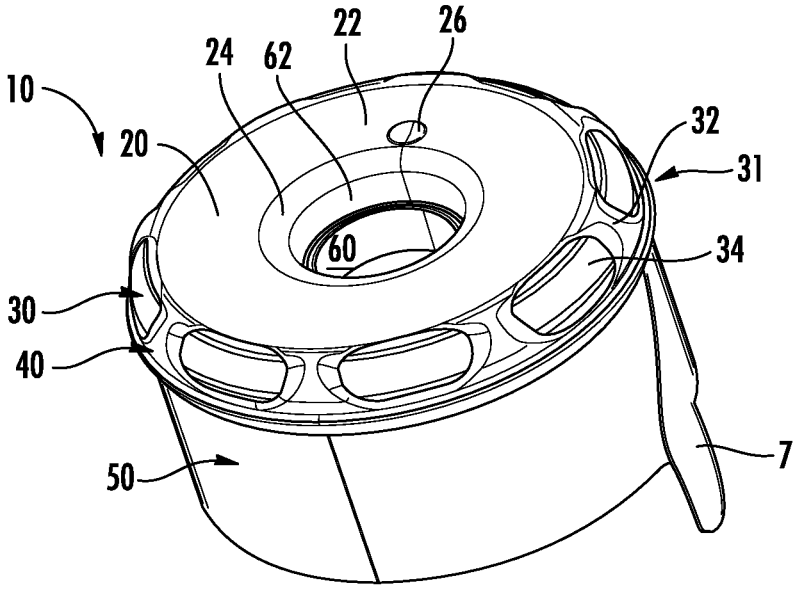

Although shoulder 30 may be formed to have a generally uniform, uninterrupted external surface 31 having a uniform profile around the circumference of the closure 10, in some embodiments, such as shown in FIGS. 12A and 12B, the shoulder 30 has an external surface 31 on which is formed a plurality of full-depth wall sections 32 and a plurality of recesses 34. The recesses 34 are preferably separately spaced between two adjacent full-depth wall sections 32. The number of recesses and full-depth wall sections will most likely depend on the intended application, the closure dimensions, and the choice of resin for the closure.

Preferably, however, three or more recesses 34 and full-depth wall sections 32 are formed around the shoulder 30, since this provides a more balanced strut-like connection between the top 20 and the skirt 50 of the closure 10. In any event, should weld line integrity be a concern, positioning a full thickness region (such as a full-depth wall section) at the position of the weld line should be considered for reasons explained in detail below.

Figure 13A:
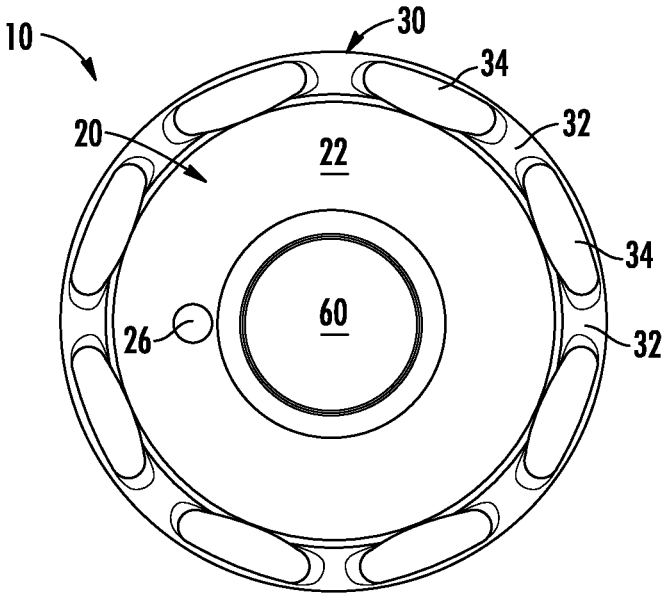
FIGS. 13A and 13B are top views of the closures of FIGS. 12A and 12B according to an exemplary embodiment.
Figure 13B:
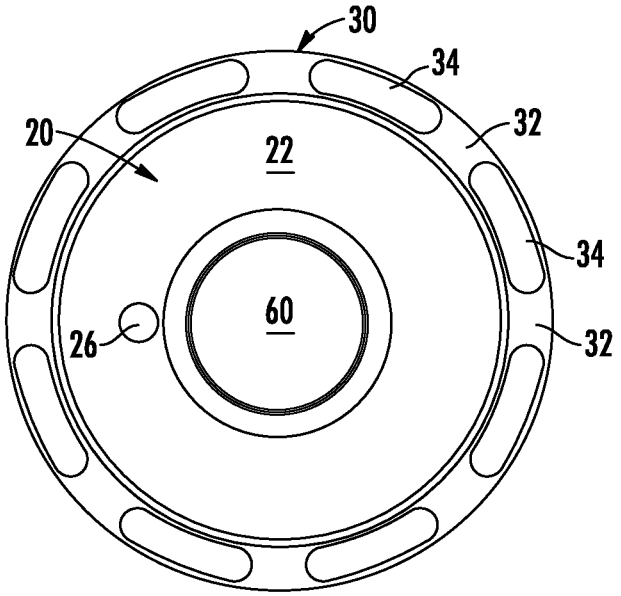

In the embodiment shown in FIG. 13A, there are eight full-depth wall sections 32 and eight recesses 34, ordered alternately around the shoulder 30. In this embodiment, the recesses 34 are angular and spaced regularly around the periphery of the closure 10. This arrangement has been found to provide a significant weight reduction for the closure while maintaining its integrity.

The shape of the full-depth wall sections 32 is such that the sections form a rounded corner between the top 20 and the skirt 50. The full-depth wall sections 32 accordingly provide structural strength to the shoulder 30, in particular when transmitting forces from the top 20 to the skirt 50 upon application of the closure 10 to a container neck.

Although in principle any size of full-depth wall sections 32 could be used, it is preferable for the circumferential extent of each full-depth wall section 32 to be greater than about 3 mm in order to provide such a strut-like effect to the closure 10. It will be appreciated that the greater the circumferential extent, the stronger that section of the shoulder 30 will be. Accordingly, the number and circumferential extent of the full-depth wall sections 32 are to be balanced with the desire to reduce the weight of the closure 10 by means of recesses 34.

The thickness of the full-depth wall sections 32 does not have to be uniform around the shoulder 30. Preferably, however, these wall sections 32 have an average thickness of about 2 mm. In addition, the thickness of the wall at the recesses 34 does not need to be identical for each recess. However, preferably the recesses 34 are identical in shape and thickness for aesthetic reasons and ease of manufacture. Preferably, the thickness at the center of the recess 34 is greater than about 0.5 mm, but at least thick enough for the closure 10 to maintain an adequate and secure seal.

Each recess 34 is disposed between a pair of full-depth wall sections 32. In this embodiment, the recess 34 has a shallow, shell-like or "scalloped" shape. The wall thickness of the shoulder 30 is arranged to vary smoothly from the full-depth thickness at a wall section 32 down to a minimum wall thickness at the center of each recess 34. The smooth variation in the external surface 31 facilitates molding of the closure 10 and reduces the occurrence of weak points around the shoulder 30.

The formation of one or more indentations or recesses 34 in the external surface 31 of the shoulder 30, while maintaining one or more other parts of the shoulder 30 at normal or full thickness, provides multiple advantages. First, the closure 10 requires a reduced amount of resin to mold the closure 10 and therefore has a reduced weight in comparison to closure 10 having a uniform, uninterrupted shoulder 30. Although it will be appreciated that the wall thickness of the full-depth wall sections 32 may not be entirely constant around the shoulder 30, the thickness of the wall sections 32 is generally about 1.5 to 3.0 mm. This wall thickness reduces to about 0.8-0.85 mm at the center of each recess 34. Of course, the wall thickness at the center of a recess 34 may be greater or smaller than this. It is also not necessary for each recess 34 or each full-depth wall section 32 to have the same central wall thickness. Depending on the application for the closure, these dimensions may vary. However, with the above dimensions, it is possible to reduce the weight of a closure by up to 10 percent or more compared with known closures. This represents a saving of up to around 1 gram of resin per closure, which is a significant reduction in material usage.

Another advantage of the arrangement of recesses 34 is improved manufacturing. With less resin required per closure 10, less time may be taken to inject the resin into the closure molds and less time may be required for the closures 10 to cure, so that the manufacture of such closures 10 becomes more efficient. This can, in turn, lead to a greater yield per unit time and/or manufacturing cost savings. The manufacturing cycle times are not only improved as a result of the better cooling characteristics for the closure, but also as a result of the greater ease with which the molded closures 10 may be ejected from the molding tool. This again provides economic and environmental advantages.

Although regions of the shoulder 30 are formed with reduced thickness walls, the integrity of the closure 10 is maintained by the one or more full-depth wall sections 32. In this way, unwanted deformation of the closure 10 upon application to a container neck may be avoided. The full-depth wall sections 32 may also act like struts to maintain the general rigidity of the closure 10 during application to a container neck, while permitting the closure 10 to flex as required to overcome a snap engagement formation on the container neck.

Figure 14:
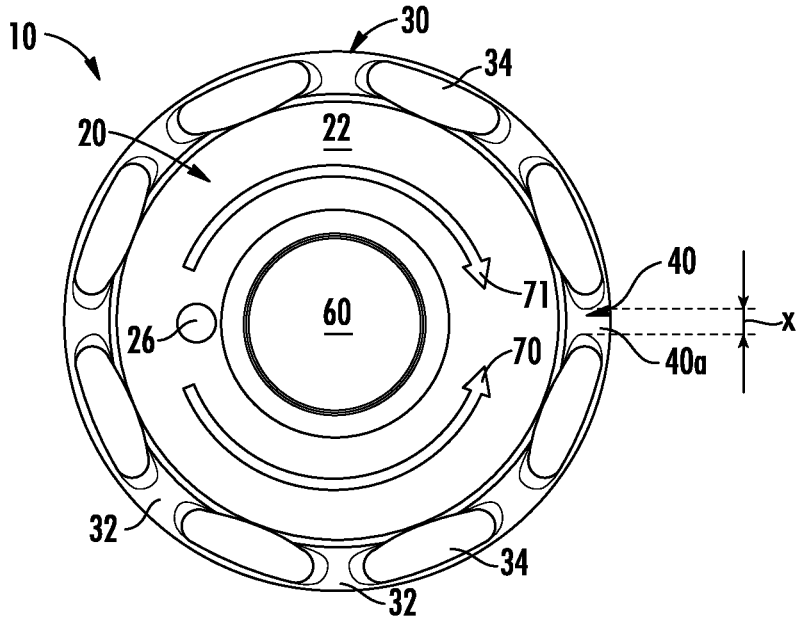
FIG. 14 is a top view of the closure of FIGS. 12A and 12B, illustrating resin flow path directions.

FIG. 14 illustrates flow paths of the resin when a closure 10 is injection molded. The well 60 is located centrally in the top 20 of the closure 10. Accordingly, the injection point of the injection molding apparatus needs to be off center and is located at a position corresponding to injection point 26. When the molten plastic is injected into the mold the plastic flows out of the injection point to fill the mold. As it does so, the material flow splits and follows in paths generally illustrated by arrows 70 and 71. As the resin flows around the mold, the two flow paths meet at the opposite side of the mold to the injection point, generally at the furthest point away from the injection point in the mold. The flow paths therefore form a weld joint 40*a* at this location 40. In order to ensure that the weld joint 40*a* has adequate strength the location 40 is arranged in this embodiment to coincide with a full-depth wall section 32. In this way, there is enough material at the location 40 for a reliable weld to be formed, thereby preventing the possible formation of weak points in the closure.

Given the flow characteristics of the resin in the injection mold, the weld joint 40*a* is generally formed in a longitudinal direction (i.e. generally perpendicular to the plane of the diagram shown in FIG. 14). The full-depth wall section 32 disposed at the location 40 is not reduced in thickness in this longitudinal direction so that the closure 10 may maintain its integrity at the weld joint 40*a*. As mentioned above, the circumferential extent of a full-depth wall section 32 is preferably about 1.5 mm or greater. The circumferential extent of the wall section 32 disposed at the location 40 is marked in FIG. 14 with the symbol "X". Where the dimensions of the closure 10 are different, for application to containers of different sizes, it is preferable for the wall sections to subtend an angle at the center of the top 20 in the range between 5 degrees and 25 degrees. In this way, the wall section X is provided with sufficient plastics material, both longitudinally and laterally, to maintain the strength of the closure 10 at the side opposite the injection point 26.

In order for the above closure arrangement to be achieved, it is preferred that the location on shoulder 30 which is furthest from the injection point 26, location 40, correspond to one of the relatively thicker wall sections 32 of the shoulder. In other words, it should be possible to define a line, which passes from the injection point 26, substantially through the center of the top 20, and terminates in a full-depth wall section 32. In this way, the weld joint 40*a* formed longitudinally in the closure 10 is formed through a full-depth section 32 and not through a thin walled recess 34.

Figure 15:
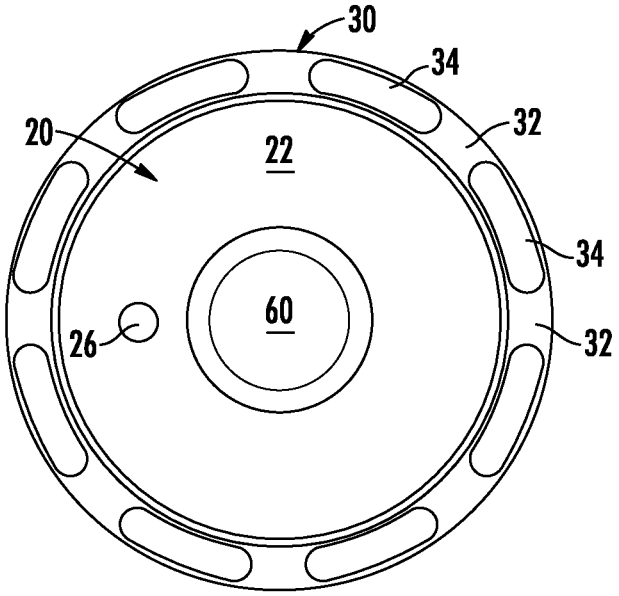
FIG. 15 is a top view of a closure, illustrating alternative placement for the full-depth and recessed wall sections according to an exemplary embodiment.

FIG. 15 shows an alternate closure top, illustrating a plurality of walled recesses 34 and full-depth sections 32. In this embodiment, a walled recess 34 is placed near the injection point 26, while opposite the injection point 26 is a full depth section 32. Thus, when a plane perpendicular to the top 20 passes through the injection point and a center of the top 20 the plane will intersect a recessed section 34 and a full-depth section 32.

The wall sections 32 have been described above as being "full-depth" or "normal thickness" wall sections. While it is preferable for the wall thickness of the shoulder 30 at the weld location 40 to be the full-depth dimension, an alternative embodiment provides this location with a wall thickness lying between a minimum thickness (as at the center of a recess 34) and a maximum thickness (as at wall section 32). In any case, the wall thickness at the location 40 needs to be sufficient to provide an effective weld, capable of withstanding the forces exerted when the closure is applied to a container neck. Accordingly, the references above to "full-depth" or "normal depth" wall sections are to be interpreted in a relative sense.

Although the embodiments described herein have described non-spill closure embodiments comprising a top 20 having a well 60 initially sealed by a plug 11, any of the embodiments described herein may equally be applied to flat top closures. This type of flat-top closure is removed from the container prior to mounting on the dispensing apparatus. The structure of such a flat top closure is substantially the same as that described in the embodiments above, except that, instead of a central well 60 and annular disc 22 surrounding a well 60 in which a plug 11 is positioned, the top 20 is formed by a substantially planar, uninterrupted disc. Furthermore, for ease of manufacture, the injection point may be located at the center of the top 20, so that the injection point is also located at the center. In this case, weld line concerns are greatly diminished.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

For purposes of this disclosure, the term "coupled" or "attached to" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above in the implementation of the teachings of the present disclosure.

What is claimed:

1. A closure for a container, the closure centered about a longitudinal axis and comprising:

a top panel;

an annular skirt extending downwardly from a lower surface of the top panel;

an engagement element extending from the annular skirt that attaches the closure to a container;

a circular rim extending downwards from the lower surface of the top panel, the circular rim terminating at a lower end lying along a generally horizontal plane, the circular rim being radially closer to the longitudinal axis than the annular skirt;

a space defined between the lower surface of the top panel, an inner surface of the annular skirt, an outer surface of the circular rim, and the plane on which the lower end of the circular rim terminates;

a first projection extending circumferentially downward from the top panel into the space, the first projection defining an inner surface facing towards the axis and an outer surface facing away from the axis, wherein the inner surface is angled relative to the axis at a first angle between 1 degree and 10 degrees relative to vertical, and the outer surface is angled relative to the axis at a second angle between 1 degree and 10 degrees relative to vertical;

a second projection that comprises at least three distinct attachment points, each of the three distinct attachment points extending from one of the lower surface of the top panel, the inner surface of the annular skirt, and the outer surface of the circular rim; and a liner located within the space, the liner attached to and supported by the first projection.

2. The closure of claim 1, wherein the first projection circumferentially surrounds the circular rim with an unbroken and uninterrupted periphery.

3. The closure of claim 2, wherein the first projection extends downward between 0.01 inches and 0.06 inches from the top panel.

4. The closure of claim 1, wherein the first projection extends downward between 0.01 inches and 0.06 inches from the top panel.

5. The closure of claim 1, wherein the first projection is formed from two or more sections such that the first projection circumferentially surrounds the circular rim with a broken and interrupted periphery.

6. The closure of claim 1, the annular skirt having a maximum inner diameter of between 1.8 and 2.3 inches.

7. The closure of claim 6, the circular rim having a diameter as measured at a bottommost portion of the circular rim or between 1.5 and 1.7 inches.

8. The closure of claim 1, comprising a third projection extending from the lower surface of the top panel at a first angle, and a fourth projection extending from the lower surface of the top panel at a second angle different from the first angle.

9. The closure of claim 1, comprising a third projection that defines an aperture.

10. A closure for a container, the closure centered about a longitudinal axis and comprising:

a top panel;

an annular skirt extending downwardly from a lower surface of the top panel;

an engagement element extending from the annular skirt that attaches the closure to a container;

a circular rim extending downwards from the lower surface of the top panel, the circular rim terminating at a lower end lying along a generally horizontal plane, the circular rim being radially closer to the longitudinal axis than the annular skirt;

a space defined between the lower surface of the top panel, an inner surface of the annular skirt, an outer surface of the circular rim, and the plane on which the lower end of the circular rim terminates;

a first projection extending circumferentially downward from the top panel into the space, the first projection defining an inner surface facing towards the axis and an outer surface facing away from the axis, wherein the inner surface is angled relative to the axis at a first angle between 1 degree and 10 degrees relative to vertical, and the outer surface is angled relative to the axis at a second angle between 1 degree and 10 degrees relative to vertical;

a second projection extending into the space, the second projection comprising a hook; and a liner located within the space, the liner attached to and supported by the first projection.

11. A closure for a container, the closure centered about a longitudinal axis and comprising:

a top panel;

an annular skirt extending downwardly from a lower surface of the top panel;

an engagement element extending from the annular skirt that attaches the closure to a container;

a circular rim extending downwards from the lower surface of the top panel, the circular rim terminating at a lower end lying along a generally horizontal plane, the circular rim being radially closer to the longitudinal axis than the annular skirt;

a space defined between the lower surface of the top panel, an inner surface of the annular skirt, an outer surface of the circular rim, and the plane on which the lower end of the circular rim terminates;

a first projection extending circumferentially downward from the top panel into the space, the first projection defining an inner surface facing towards the axis and an outer surface facing away from the axis, wherein the inner surface is angled relative to the axis at a first angle between 1 degree and 10 degrees relative to vertical, and the outer surface is angled relative to the axis at a second angle between 1 degree and 10 degrees relative to vertical;

a second projection extending into the space, the second projection comprising a spiral; and a liner located within the space, the liner attached to and supported by the first projection.

12. A closure for a container, the closure centered about a longitudinal axis and comprising:

a top panel;

an annular skirt extending downwardly from a lower surface of the top panel;

an engagement element extending from the annular skirt that attaches the closure to a container;

a circular rim extending downwards from the lower surface of the top panel, the circular rim terminating at a lower end lying along a generally horizontal plane, the circular rim being radially closer to the longitudinal axis than the annular skirt;

a space defined between the lower surface of the top panel, an inner surface of the annular skirt, an outer surface of the circular rim, and the plane on which the lower end of the circular rim terminates;

a first projection extending into the space, the first projection comprising a hook; and a liner located within the space, the liner attached to and supported by the first projection.

13. The closure of claim 12, the first projection having a non-uniformly textured surface.

14. The closure of claim 12, comprising a second projection that extends from the lower surface of the top panel at a first angle, and a third projection that extends from the lower surface of the top panel at a second angle different from the first angle.

15. The closure of claim 12, comprising a second projection that comprises at least three distinct attachment points, each of the three distinct attachment points extending from one of the lower surface of the top panel, the inner surface of the annular skirt, and the outer surface of the circular rim.

16. A closure for a container, the closure centered about a longitudinal axis and comprising:

a top panel;

an annular skirt extending downwardly from a lower surface of the top panel;

an engagement element extending from the annular skirt that attaches the closure to a container;

a circular rim extending downwards from the lower surface of the top panel, the circular rim terminating at a lower end lying along a generally horizontal plane, the circular rim being radially closer to the longitudinal axis than the annular skirt;

a space defined between the lower surface of the top panel, an inner surface of the annular skirt, an outer surface of the circular rim, and the plane on which the lower end of the circular rim terminates;

a first projection extending into the space, the projection comprising a spiral; and a liner located within the space, the liner attached to and supported by the projection.

17. The closure of claim 16, the first projection having a non-uniformly textured surface.

18. The closure of claim 16, comprising a second projection that comprises a spiral and that extends from the lower surface of the top panel at a first angle, and a third projection that comprises a spiral and that extends from the lower surface of the top panel at a second angle different from the first angle.

19. The closure of claim 18, comprising a second projection that comprises at least three distinct attachment points, each of the three distinct attachment points extending from one of the lower surface of the top panel, the inner surface of the annular skirt, and the outer surface of the circular rim.

* * * * *